US010208537B2

(12) United States Patent
Kwak

(10) Patent No.: US 10,208,537 B2
(45) **Date of Patent: *Feb. 19, 2019**

(54) DEVICE FOR ADJUSTING FABRIC ANGLE OF DOUBLE FABRIC BLINDS

(71) Applicant: Comfortex Window Fashions, Maplewood, NY (US)

(72) Inventor: Jae Suk Kwak, Gyeonggi-do (KR)

(73) Assignee: Comfortex Window Fashions, Maplewood, NY (US)

( * ) Notice: Subject to any disclaimer, the term of this patent is extended or adjusted under 35 U.S.C. 154(b) by 91 days.

This patent is subject to a terminal disclaimer.

(21) Appl. No.: 15/200,044

(22) Filed: Jul. 1, 2016

(65) Prior Publication Data

US 2016/0312531 A1 Oct. 27, 2016

Related U.S. Application Data

(63) Continuation of application No. 14/468,856, filed on Aug. 26, 2014, now Pat. No. 9,410,366.

(30) Foreign Application Priority Data

Aug. 27, 2013 (KR) ..... 10-2013-0101429

(51) Int. Cl.
*E06B 9/08* (2006.01)
*E06B 9/60* (2006.01)
(Continued)

(52) U.S. Cl.
CPC ..... *E06B 9/60* (2013.01); *E06B 9/262* (2013.01); *E06B 9/303* (2013.01); *E06B 9/32* (2013.01);
(Continued)

(58) Field of Classification Search
CPC ... E06B 9/60; E06B 9/262; E06B 9/32; E06B 9/322; E06B 9/34; E06B 9/90;
(Continued)

(56) References Cited

U.S. PATENT DOCUMENTS 1,344,448 A 6/1920 Johnstone
2,175,549 A 10/1939 Nardulli et al.
(Continued)

FOREIGN PATENT DOCUMENTS

CH 696497 A5 7/2007
CN 102733746 A 10/2012
(Continued)

OTHER PUBLICATIONS

Patent Cooperation Treaty, Notification of Transmittal of the International Search Report and the Written Opinion of the International Searching Authority for PCT/US2014/052655 dated Dec. 15, 2014, 9 pages.
(Continued)

*Primary Examiner* — Katherine W Mitchell
*Assistant Examiner* — Johnnie A. Shablack
(74) *Attorney, Agent, or Firm* — Hoffman Warnick LLC

(57) ABSTRACT

The present invention relates to double fabric blinds and, more particularly, to a device for adjusting a fabric angle of the double fabric blinds, which is capable of finely adjusting an degree of openness of a front sheet, wherein a plurality of balls are sequentially held in a holding groove, e.g., as four or eight balls, inserted into an insertion groove of a rotation component, wherein the plurality of balls are rotated in a guide groove of a stopper by approximately 90 degrees or 45 degrees, thereby improving safety and omitting the use of a conventional string.

20 Claims, 15 Drawing Sheets

(51) Int. Cl.

| | |
|---|---|
| ***E06B 9/262*** | (2006.01) |
| ***E06B 9/32*** | (2006.01) |
| ***E06B 9/322*** | (2006.01) |
| ***E06B 9/34*** | (2006.01) |
| ***E06B 9/40*** | (2006.01) |
| ***E06B 9/58*** | (2006.01) |
| ***E06B 9/303*** | (2006.01) |
| ***E06B 9/42*** | (2006.01) |
| ***E06B 9/90*** | (2006.01) |
| *E06B 9/24* | (2006.01) |
| *E06B 9/80* | (2006.01) |

(52) U.S. Cl.
CPC ..... *E06B 9/322* (2013.01); *E06B 9/34* (2013.01); *E06B 9/40* (2013.01); *E06B 9/42* (2013.01); *E06B 9/582* (2013.01); *E06B 9/90* (2013.01); *E06B 2009/2435* (2013.01); *E06B 2009/2627* (2013.01); *E06B 2009/3222* (2013.01); *E06B 2009/801* (2013.01); *E06B 2009/905* (2013.01)

(58) Field of Classification Search
CPC ..... E06B 2009/2435; E06B 2009/3222; E06B 2009/801; E06B 2009/905
USPC ..... 160/84.04, 84.05, 133, 291, 297, 120, 160/122, 121.1, 177 R, 178.1 R
See application file for complete search history.

(56) References Cited

U.S. PATENT DOCUMENTS 2,245,902 A 6/1941 Cohn
2,723,715 A 11/1955 Kauffmann et al.
2,914,122 A 11/1959 Pinto
3,384,519 A 5/1968 Froget
4,009,745 A * 3/1977 Erpenbeck ..... E06B 9/60 160/297
4,194,550 A 3/1980 Hopper
4,250,942 A * 2/1981 Dreher ..... F03G 1/06 160/297
4,345,636 A * 8/1982 Fukuchi ..... E06B 9/90 160/297
4,498,517 A * 2/1985 Mase ..... E06B 9/82 160/294
5,036,898 A 9/1991 Chen
5,099,906 A 3/1992 Chigusa et al.
5,123,472 A 6/1992 Nagashima et al.
5,285,838 A 2/1994 Rapp et al.
5,287,908 A 2/1994 Hoffmann et al.
5,301,737 A 4/1994 Martin
5,309,974 A 5/1994 Fraser
5,313,999 A 5/1994 Colson et al.
5,320,154 A 6/1994 Colson et al.
5,339,882 A 8/1994 Judkins
5,394,922 A 3/1995 Colson et al.
5,419,385 A 5/1995 Vogel et al.
5,421,221 A 6/1995 Warchocki
5,456,304 A 10/1995 Colson et al.
5,566,741 A * 10/1996 Ogawara ..... E06B 9/90 160/297
5,664,613 A 9/1997 Jelic
5,690,317 A 11/1997 Sandsborg
5,855,235 A 1/1999 Colson et al.
5,888,639 A 3/1999 Green et al.
6,001,199 A 12/1999 Colson et al.
6,024,819 A 2/2000 Corey
6,105,652 A 8/2000 Judkins
6,112,797 A 9/2000 Colson et al.
6,116,325 A 9/2000 Colson et al.
6,142,211 A 11/2000 Judkins
6,158,563 A 12/2000 Welfonder et al.
6,164,428 A 12/2000 Berman et al.
6,171,424 B1 1/2001 Barss
6,289,964 B1 9/2001 Colson et al.
6,302,982 B1 10/2001 Corey et al.
6,377,384 B2 4/2002 Corey et al.
6,435,252 B2 8/2002 Colson et al.
6,484,786 B1 11/2002 Ruggles et al.
6,529,323 B2 3/2003 Okumura
6,546,989 B2 4/2003 Coleman et al.
6,575,222 B2 6/2003 Corey et al.
6,634,409 B2 10/2003 Corey et al.
6,688,369 B2 2/2004 Colson et al.
6,688,370 B1 2/2004 Nien
6,745,811 B1 6/2004 Nien
6,782,938 B2 8/2004 Colson et al.
6,823,923 B2 11/2004 Palmer
6,948,544 B2 9/2005 Nien
7,128,121 B2 10/2006 Nien
7,267,156 B2 9/2007 Byeon
7,311,131 B2 12/2007 Nien et al.
7,380,582 B1 6/2008 Anderson et al.
7,401,634 B2 7/2008 Kovach et al.
7,438,115 B2 10/2008 Bohlen
7,500,505 B2 3/2009 Smith et al.
7,520,310 B2 4/2009 Colosio
7,549,455 B2 6/2009 Harper et al.
7,624,785 B2 12/2009 Yu et al.
7,665,507 B2 * 2/2010 Naoki ..... E06B 9/42 160/170
7,836,937 B2 11/2010 Anderson et al.
8,191,605 B2 * 6/2012 Kwak ..... E06B 9/42 160/193
8,281,846 B2 10/2012 Zhu
8,327,906 B2 12/2012 Kwak
8,342,309 B2 * 1/2013 Takagi ..... E06B 9/322 160/298
8,356,653 B2 1/2013 Fu-Lai et al.
8,418,742 B2 4/2013 Anderson et al.
8,517,081 B2 8/2013 Huang
8,556,204 B2 10/2013 Kao
8,662,139 B2 3/2014 Anthony et al.
8,746,320 B2 6/2014 Yu et al.
8,763,674 B2 7/2014 Kataoka et al.
8,807,192 B2 8/2014 Marocco
8,851,143 B2 * 10/2014 Zhu ..... E06B 9/38 160/121.1
9,062,492 B2 * 6/2015 Yu ..... E06B 9/322
9,187,951 B2 * 11/2015 Yu ..... E06B 9/322
9,284,774 B2 * 3/2016 Yu ..... E06B 9/38
9,322,210 B2 4/2016 Lukosiunas et al.
9,353,570 B2 * 5/2016 Smith ..... E06B 9/38
9,410,366 B2 8/2016 Kwak
9,512,672 B2 * 12/2016 Colson ..... E06B 9/42
9,528,318 B2 * 12/2016 Huang ..... E06B 9/262
9,719,297 B1 * 8/2017 Chen ..... E06B 9/34
9,765,864 B2 * 9/2017 Yu ..... F16H 19/06
9,816,317 B2 * 11/2017 Chen ..... E06B 9/60
9,840,867 B2 * 12/2017 Lukosiunas ..... E06B 9/34
2001/0037864 A1 11/2001 Colson et al.
2002/0048083 A1 4/2002 Okumura
2004/0226663 A1 11/2004 Smith et al.
2005/0150608 A1 7/2005 Auger et al.
2006/0272783 A1 12/2006 Smith et al.
2007/0079943 A1 4/2007 Smith et al.
2007/0175596 A1 8/2007 Chien
2008/0202709 A1 8/2008 Anderson et al.
2009/0223641 A1 9/2009 Cheng
2010/0122780 A1 5/2010 Cheng
2010/0206495 A1 8/2010 Lin
2011/0100568 A1 5/2011 Kao
2011/0126959 A1 6/2011 Holt et al.
2011/0209836 A1 9/2011 Yu et al.
2011/0247768 A1 * 10/2011 Kwak ..... E06B 9/326 160/319
2012/0152470 A1 * 6/2012 Chen ..... E06B 9/42 160/292
2012/0222828 A1 9/2012 Kwak
2012/0298318 A1 11/2012 Wolek
2014/0138037 A1 * 5/2014 Colson ..... E06B 9/42 160/290.1
2014/0216666 A1 8/2014 Smith et al.

(56) References Cited

U.S. PATENT DOCUMENTS

| | | | | |
|---|---|---|---|---|
| 2014/0262066 | A1* | 9/2014 | Certain | E06B 9/26 160/84.02 |
| 2014/0262068 | A1* | 9/2014 | Buccola, Jr. | E06B 9/322 160/120 |
| 2014/0262069 | A1 | 9/2014 | Drew et al. | |
| 2015/0007946 | A1 | 1/2015 | Yu et al. | |
| 2015/0034257 | A1 | 2/2015 | Blair et al. | |
| 2015/0034260 | A1 | 2/2015 | Blair et al. | |
| 2015/0047792 | A1* | 2/2015 | Lukosiunas | E06B 9/26 160/84.05 |
| 2015/0059991 | A1* | 3/2015 | Kwak | E06B 9/262 160/113 |
| 2015/0292261 | A1 | 10/2015 | Chou | |
| 2016/0138332 | A1* | 5/2016 | Lukosiunas | E06B 9/26 160/84.05 |
| 2016/0258211 | A1* | 9/2016 | Smith | E06B 9/38 |
| 2017/0114592 | A1* | 4/2017 | Huang | E06B 9/322 |
| 2017/0167190 | A1* | 6/2017 | Brioschi | E06B 9/60 |

FOREIGN PATENT DOCUMENTS

| | | | |
|---|---|---|---|
| EP | 0705957 | A1 | 4/1996 |
| EP | 0972906 | A1 | 1/2000 |
| EP | 2733302 | A2 | 5/2014 |
| FR | 1521488 | A | 4/1968 |
| JP | H05179878 | A | 7/1993 |
| JP | H07279560 | A | 10/1995 |
| JP | H08144667 | A | 6/1996 |
| JP | H09170390 | A | 6/1997 |
| JP | 2008188470 | A | 8/2008 |
| JP | 2008231913 | A | 10/2008 |
| KR | 20060066012 | A | 6/2006 |
| KR | 100675556 | B1 | 2/2007 |
| KR | 100943408 | B1 | 2/2010 |
| KR | 101259614 | B1 | 2/2010 |
| KR | 20110139082 | A | 12/2011 |
| WO | 9937876 | A1 | 7/1999 |
| WO | 2010041880 | A1 | 4/2010 |
| WO | 2012006514 | A2 | 1/2012 |
| WO | 2013033014 | A1 | 3/2013 |
| WO | 2014115684 | A1 | 7/2014 |
| WO | 2014143057 | A1 | 9/2014 |
| WO | 2014163602 | A2 | 10/2014 |
| WO | 2014201253 | A2 | 12/2014 |
| WO | 2015030349 | A1 | 3/2015 |

OTHER PUBLICATIONS

Patent Cooperation Treaty, International Preliminary Search Report on Patentability for PCT/US2014/052655 dated Dec. 18, 2015, 5 pages.

Final Office Action for U.S. Appl. No. 14/766,155, dated Jan. 19, 2017, 11 pages.

Patent Cooperation Treaty, Notification of Transmittal of the International Search Report and the Written Opinion of the International Searching Authority for PCT/2013/032634 dated Jun. 5, 2013, 4 pages.

* cited by examiner

DEVICE FOR ADJUSTING FABRIC ANGLE OF DOUBLE FABRIC BLINDS

BACKGROUND

1. Technical Field

The present invention relates to double fabric blinds and, more particularly, to a device for adjusting a fabric angle of double fabric blinds.

2. Background Art

Referring to FIGS. 1 and 2, double fabric blinds generally use a double fabric, in which a front sheet 1 and a rear sheet 2 woven from mesh are coupled to a plurality of connection fabrics 3 extending between the front sheet 1 and the rear sheet 2, as a fabric for blinds 4 wound around a winding rod 6. Each of the connection fabrics 3 has a substantially S-shaped section and is connected in the longitudinal direction such that the front sheet 1 is spaced at a predetermined distance apart from the rear sheet 2. The front and rear sheets 1 and 2 are formed from a transparent material woven from mesh, and the plurality of connection fabrics 3 are formed from a translucent material which is more flexible than those of the front and rear sheets 1 and 2. The fabric 4 for the double fabric blinds allows light from the outside to be transmitted therein via the front and rear sheets 1 and 2 when the connection fabrics 3 are spread.

As illustrated in FIG. 2, when one of the front and rear sheets 1 and 2 moves upward, the various connection fabrics 3 are folded, and thus the front sheet 1 and the rear sheet 2 are almost in contact with each other. Simultaneously, since the plurality of connection fabrics 3 are in contact with each other, the blinds enter a translucent state in which light is transmitted through the front and rear sheets 1 and 2, but is at least partially obscured.

Turning to FIG. 3, roll blinds 9 have been manufactured by using the fabric 4 of the double fabric blinds. Roll blinds 9 can include an upper case 6, which is coupled to the winding rod 5 for winding the fabric 4 of the double fabric blinds, and a lower end bar 7 having a weight on the lower end of the double fabric. Also, a driving roller 8 is disposed on one end of the winding rod 5 so as to move the double fabric in the vertical direction, and an adjustable string 8*a* for rotating the driving roller 8 is provided. In this state, when the adjustable string 8*a* is pulled, the double fabric for blinds 4 moves downward while the driving roller 8 is rotated. The connection fabric 3 disposed between the front sheet 1 and the rear sheet 2 moves downward in the folded state, and when the fabric for blinds 4 moves down to the bottom, the folded connection fabrics 3 are spread due to the weight of the lower end bar 7.

Since conventional roll blinds have a structure in which a plurality of vanes are spread due to the weight of the lower end bar only when the double fabric moves down to the bottom, there is a limitation in that the roll blinds include no elements for allowing a user to spread the folded connection fabric at a desired position, particularly at the middle or upper positions of the double fabric, and/or adjust a spread angle of the connection fabric. Also, the conventional design includes a drop-down string (adjustable string 8*a*) which poses a safety hazard for children who may become entangled in the string.

To solve the abovementioned limitation, "blinds with adjustment for the angle of a double fabric" are disclosed in Korean patent gazette No. 10-943408, a previously owned patent also owned by the present applicant. An illustration of this assembly is provided in FIG. 4. Since the double blinds of the previously registered patent include a driving body, an angle adjustment component, two rollers, and two adjustable strings, the structure of the blinds in this configuration is relatively complicated. Although a degree of openness of the front sheet of the double fabric is adjustable via a friction member of the angle adjustment component, the abrasiveness (and associated coefficient of friction) of the friction member may deteriorate after being used for a long time, reducing the degree of openness to which the double fabric can be adjusted.

BRIEF SUMMARY

One aspect of the present invention provides adjusting of double fabric blinds and, more particularly, a device for adjusting the fabric angle of the double fabric blinds, which is capable of finely adjusting a degree of openness of such a fabric since a plurality (e.g., four or eight) of balls are sequentially held and inserted in a holding groove of a rotation component, and are rotated in a guide groove of a stopper at 90 degrees or 45 degrees, thereby reducing accidents since an adjustable string is not used. Also, the device can be easily operated since a separate lower end bar is formed on the lower ends of the front sheet and rear sheet, which can provide the same function as a handle.

To achieve the abovementioned functions, embodiments of the present invention provide a device for adjusting the fabric angle of double fabric blinds, comprising: a cover provided with an insertion hole having a hook protrusion formed therein, wherein coupling protrusions are disposed symmetrical to each other on the inner circumferential surface of the cover and protrude outward; a rotation component having coupling grooves which are coupled to the coupling protrusions of the cover, disposed symmetrical to each other on the outer circumferential surface of the rotation component, and recessed inward, and insertion grooves and a coupling hole formed in the inner circumferential surface of said rotation component, wherein a plurality of balls are inserted into the insertion grooves and a stopper is coupled to the coupling hole; a stopper having a shaft insertion hole which passes through same and has a coupling groove coupled to the hook protrusion of a spring at the lower end of said stopper, so as to be inserted into the coupling hole of the rotation component, and guide grooves, inclined grooves, and holding grooves in the outer circumferential surface of same, wherein the guide grooves and inclined grooves allow the balls to be rotated, and the holding grooves hold the balls; a fixing shaft, the front of which has the coupling protrusion coupled to a washer and the rear of which has the spring coupled to the hook protrusion projecting outward, inserted into the shaft insertion hole of the stopper; and blinds which have the plurality of balls inserted into the insertion grooves of the rotation component, to adjust the angle of the double fabric by moving in the guide groove and coupling the stopper to the rotation component. The device is characterized in that when the rotation component is rotated after four balls are inserted into the guide groove of the stopper and the rotation component is coupled to the stopper, a degree of openness of the double fabric is adjusted while the four balls are sequentially held by the holding groove as the rotation component is rotated at 90 degrees.

The present invention can provide the following technical effects.

First, a user may easily and simply adjust the degree of openness of the double fabric as desired.

Second, the opened angle of the double fabric may be finely adjusted by controlling the number of the balls inserted into the insertion grooves of the rotation component.

Third, the device of the present invention is effective in that a ball chain or an adjustable string is not used, thereby improving safety for the user.

Fourth, the device has a simple structure and reduces malfunctions from occurring during operation, thereby also reducing manufacturing costs.

DETAILED DESCRIPTION

Hereinafter, the preferred embodiments of the present invention will be described below in more detail with reference to the accompanying drawings.

Figure 1:
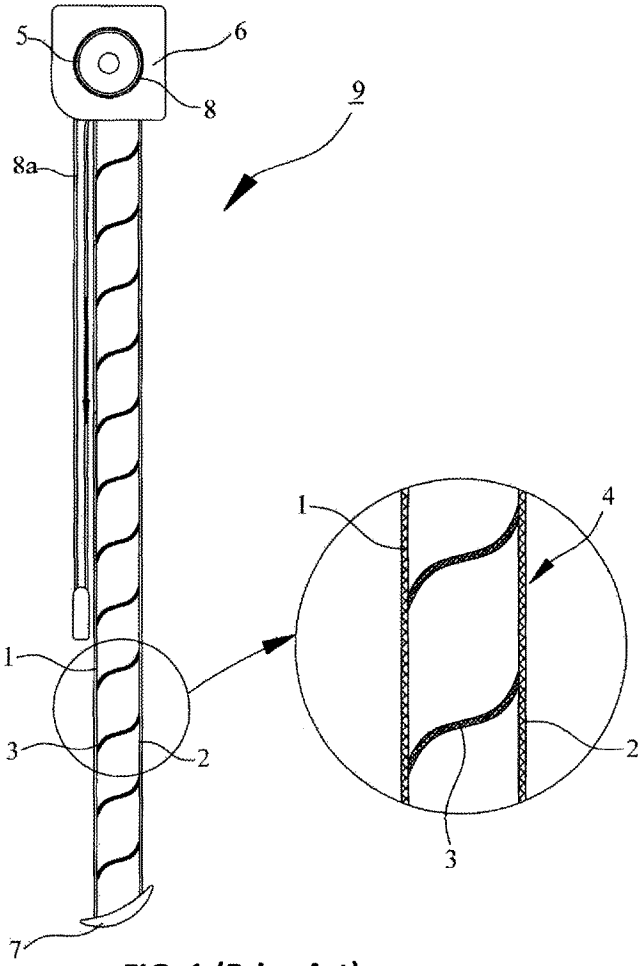
FIG. 1 (Prior Art)
FIGS. 1-3 are views illustrating a configuration and operation of conventional double fabric blinds.
Figure 2:
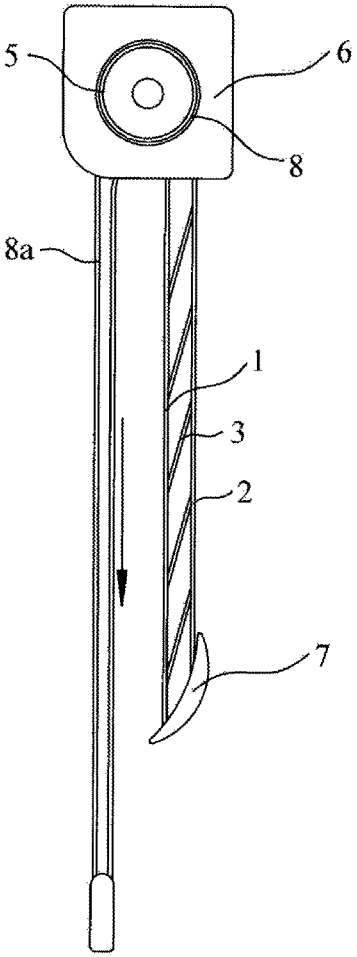
FIG. 2 (Prior Art)
Figure 3:
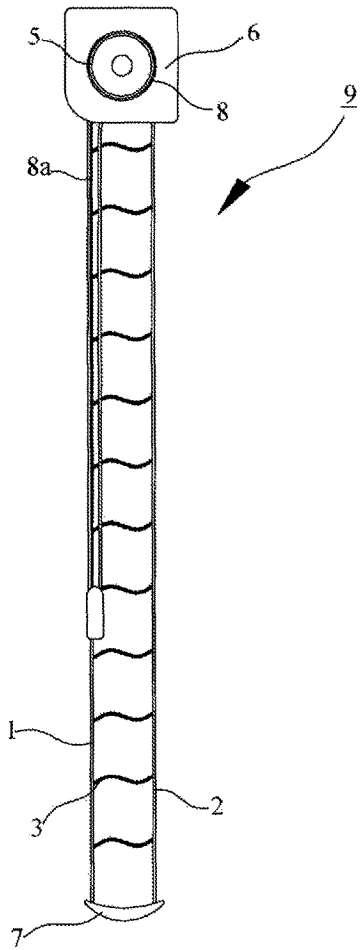
FIG. 3 (Prior Art)
Figure 4:
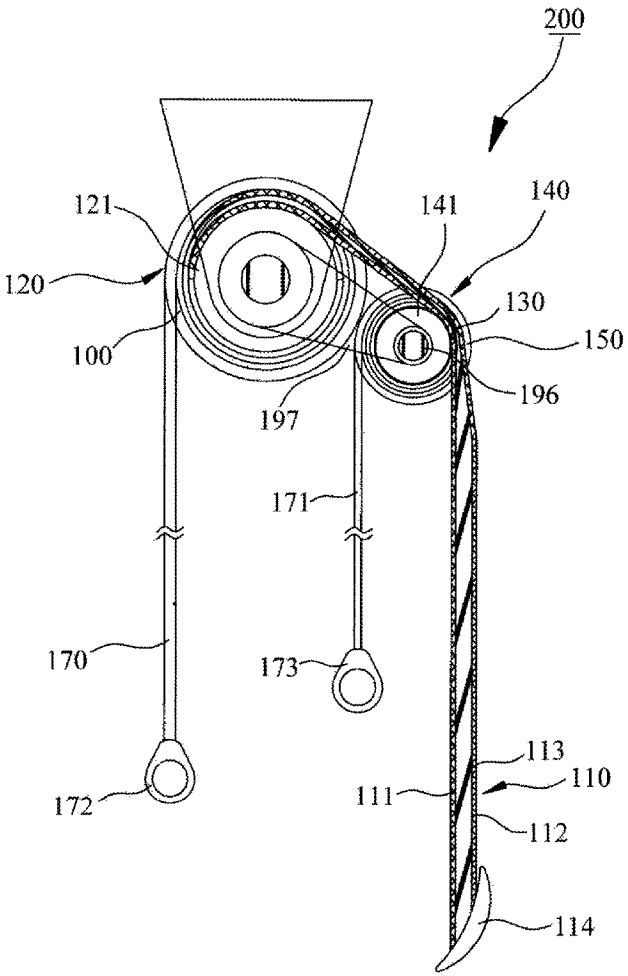
FIG. 4 (Prior Art)
FIG. 4 is a cross-sectional view illustrating double blinds of applicant's previously registered patent disclosed in Korean patent gazette No. 10-943408.
Figure 5:
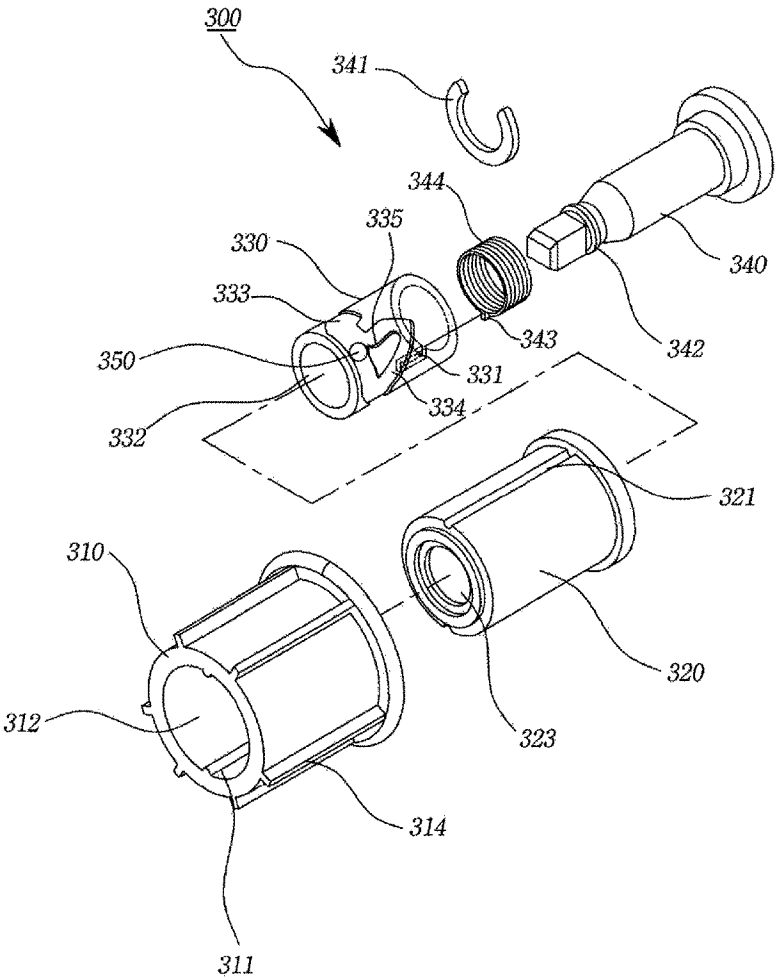
FIG. 5 is a perspective exploded view illustrating the configuration of a device for adjusting a fabric angle of double fabric blinds according to embodiments of the present invention.

Referring to FIG. 5, a body 300 of a device for adjusting a fabric angle of double fabric blinds according to embodiments of the present invention is shown. The body 300 includes: a cover 310 having a hook protrusion 312 on which a coupling protrusion 311 is formed; a rotation component 320 having an outer circumferential surface on which coupling grooves 321 disposed symmetrically relative to each other are formed, and an inner circumferential surface in which an insertion groove 322 and a coupling hole 323 are formed; a stopper 330 having a shaft insertion hole 332 and a coupling groove 331 formed on one surface of the outer circumferential surface of the stopper 330; the stopper having a guide groove 333, an inclined groove 334, and a holding groove 335 formed on the outer circumferential surface thereof, wherein a ball 350 is rotated in the guide grooves and inclined grooves 333 and 334 and held in the holding groove 335; and a fixing shaft 340, the front of which has a coupling protrusion 342 coupled to a washer 341, and the rear of which is coupled to a spring 344 having a hook protrusion 343 protruding outward.

The cover 310 has an insertion hole and a hook protrusion in which coupling protrusions are formed symmetrical to each other on the inner circumferential surface of the cover, protruding outward. Also, a plurality of protrusions 314 coupled to a winding drum around which the double fabric is wound are formed on the outer circumferential surface of the cover 310. Any desired number of protrusions 314 can be provided on cover 310. The coupling grooves 321, which are symmetrical to each other and can be in the form of semicircular grooves, are formed in the outer circumferential surface of the rotation component 320. The coupling hole 323 having the insertion grooves 322, where a plurality of balls 350 are inserted, can be formed in the inner circumferential surface of the rotation component.

Figure 6:
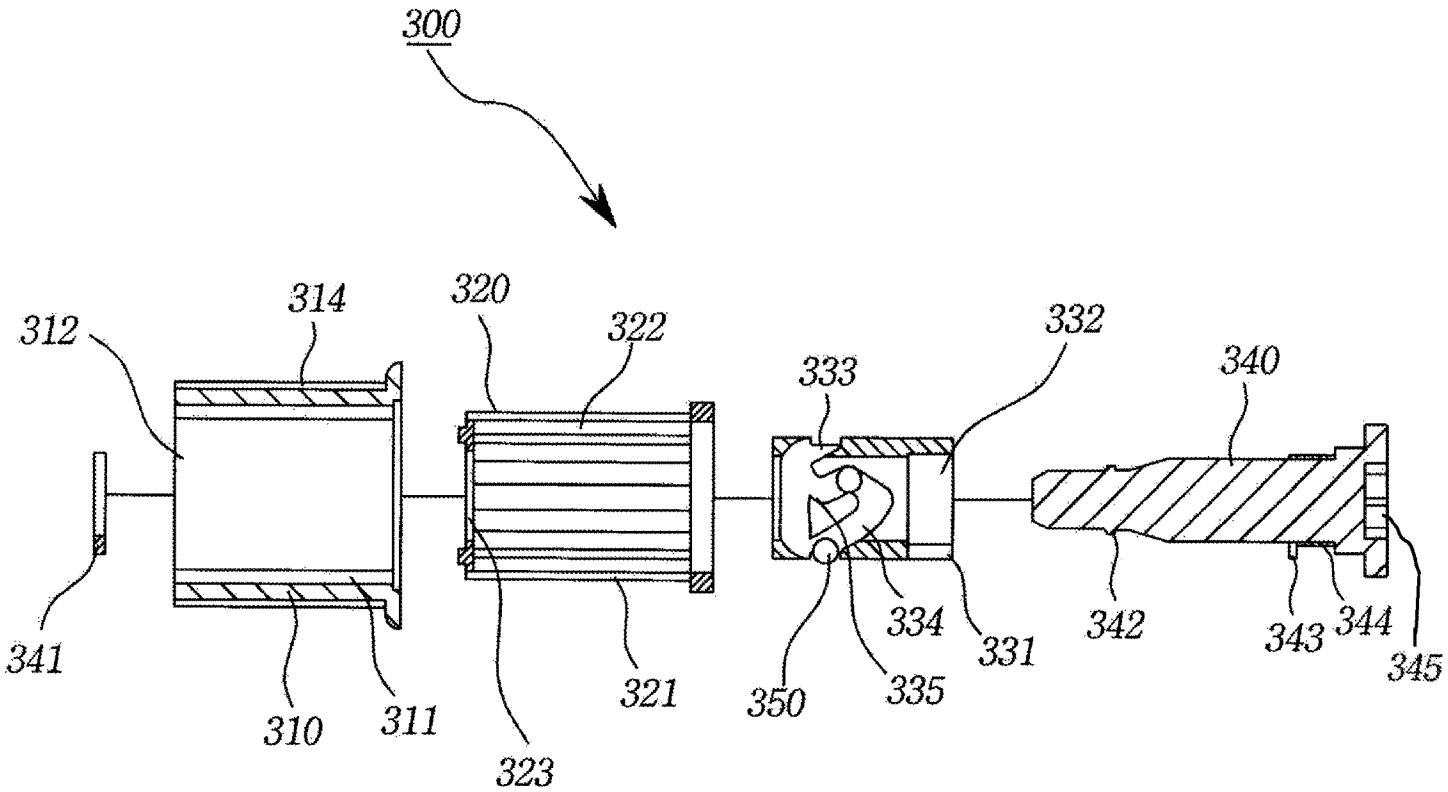
FIG. 6 is a cross-sectional view illustrating a configuration of the device for adjusting the fabric angle of double fabric blinds according to embodiments of the present invention.
Figure 7:
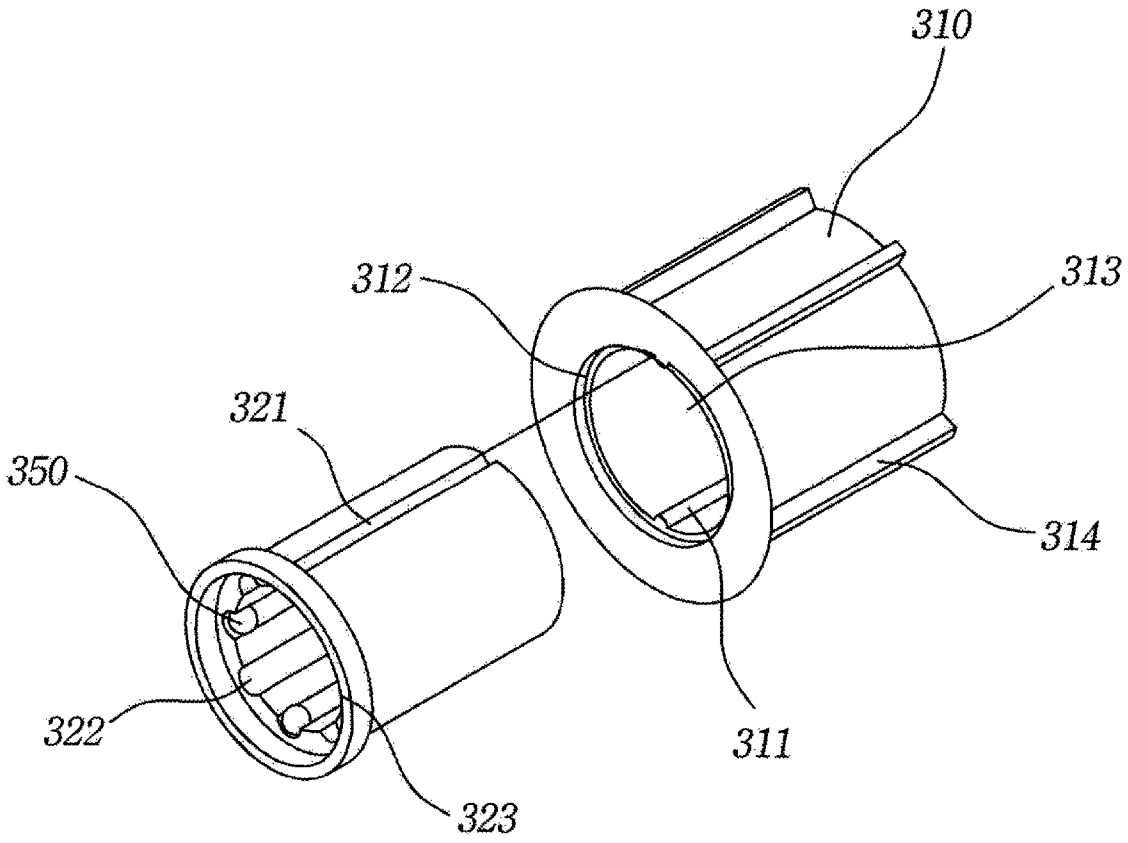
FIG. 7 is a perspective view illustrating a state in which a rotation component is coupled to a cover of the device for adjusting the fabric angle of double fabric blinds according to embodiments of the present invention.
Figure 8:
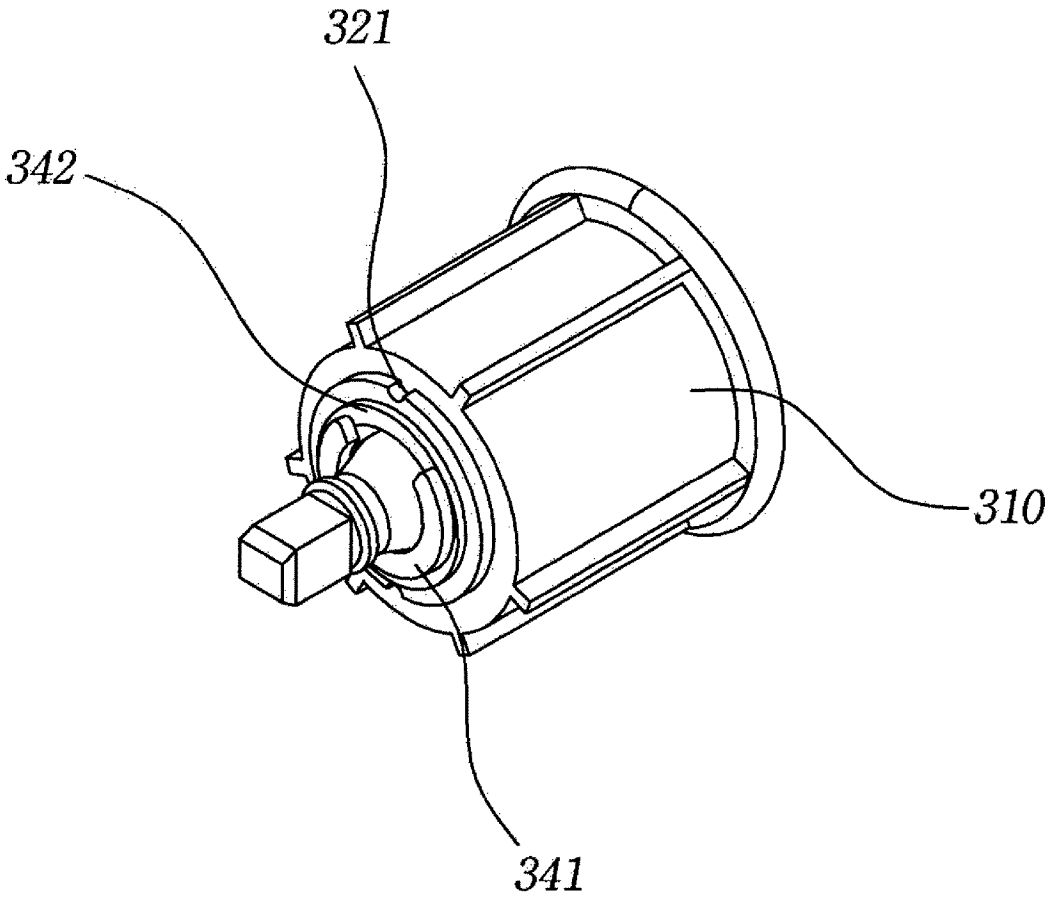
FIG. 8 is a perspective view illustrating a state in which all elements of the device for adjusting the fabric angle of double fabric blinds according to embodiments of the present invention are coupled to each other.

The insertion groove 323 can have a semicircular shape and extend in a longitudinal direction within the rotation component 320, which is illustrated in FIGS. 6-7. Also, the plurality of balls 350 can be inserted into the insertion groove 323 and used as discussed herein. In particular, four balls 350 can be inserted into the insertion groove, or eight balls 350 may alternatively be inserted for use. In other embodiments, more than eight balls 350 may be used if desired. The fixing shaft 340 is inserted into the coupling hole 323 of the rotation component 320. The stopper 330 is a pipe which can have a cylindrical shape. The coupling groove 331, to which the hook protrusion 343 of the spring 344 is coupled, is formed on one area of the inner circumferential surface of the stopper and has a predetermined length. The shaft insertion hole 332 is formed in the stopper. The guide grooves and inclined grooves 333 and 334, in which each of the balls 350 is moved, and the holding groove 335 for holding the ball 350 are formed in the outer circumferential surface of the stopper 330.

One surface of the ball 350 contacts the guide groove 333 of the stopper 330, and another surface of the ball contacts the insertion groove 322 of the rotation component 320. Thus, the rotation component 320 may hold a rotation according to the movement of the ball 350. The coupling protrusion 342, to which the washer 341 is coupled, is formed on the front of the fixing shaft 340, and the spring 344 having the hook protrusion 343 protruding outward is coupled to the rear of the fixing shaft. A coupling groove 345 is formed in the central portion of the rear surface of the shaft 340 so that a coupling protrusion of a bracket is inserted. The hook protrusion 343 of the spring 344 can be disposed on the outer circumferential surface of the fixing shaft 340 and coupled to the coupling groove 331 of the stopper 330 as described above, and thus, the stopper 330 is held by the hook protrusion.

A method for operating the abovementioned device to adjust the fabric angle of the double fabric blinds according to embodiments of the present invention will be described with reference to FIGS. 9-13. First, the coupling protrusion of the bracket is coupled to the coupling groove 345 formed in the rear surface of the fixing shaft 340, and a rotor rotated due to the elastic force of a well-known spring is mounted on a spring on a surface opposite the rear surface of the fixing shaft. Further, the winding drum, around which a double fabric 110 made of a connection fabric 113 connecting a front sheet 111 and a rear sheet 112 is wound, may be coupled and fixed to the protrusion 314 of the cover 310. Lower end rods 371 and 372 are provided on the lower ends of the front and rear sheets 111 and 112, respectively. Each of the lower end rods 371 and 372 can have a cylindrical shape and the same length as the width of the fabric. A string provided with a handle may be provided at the lower side of the lower end rod 371 of the front sheet for use.

Figure 9:
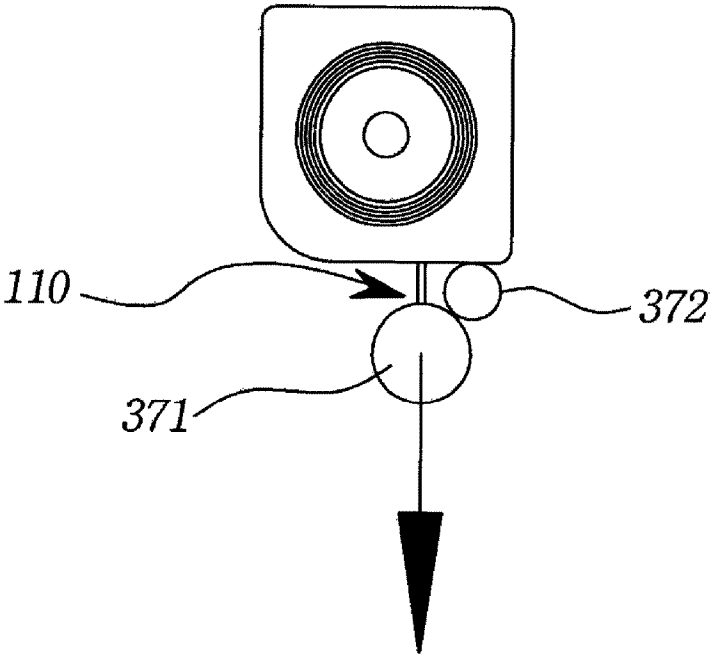
FIGS. 9-15 are views illustrating a state in which the device for adjusting the fabric angle of double fabric blinds according to embodiments of the present invention is used.
Figure 10:
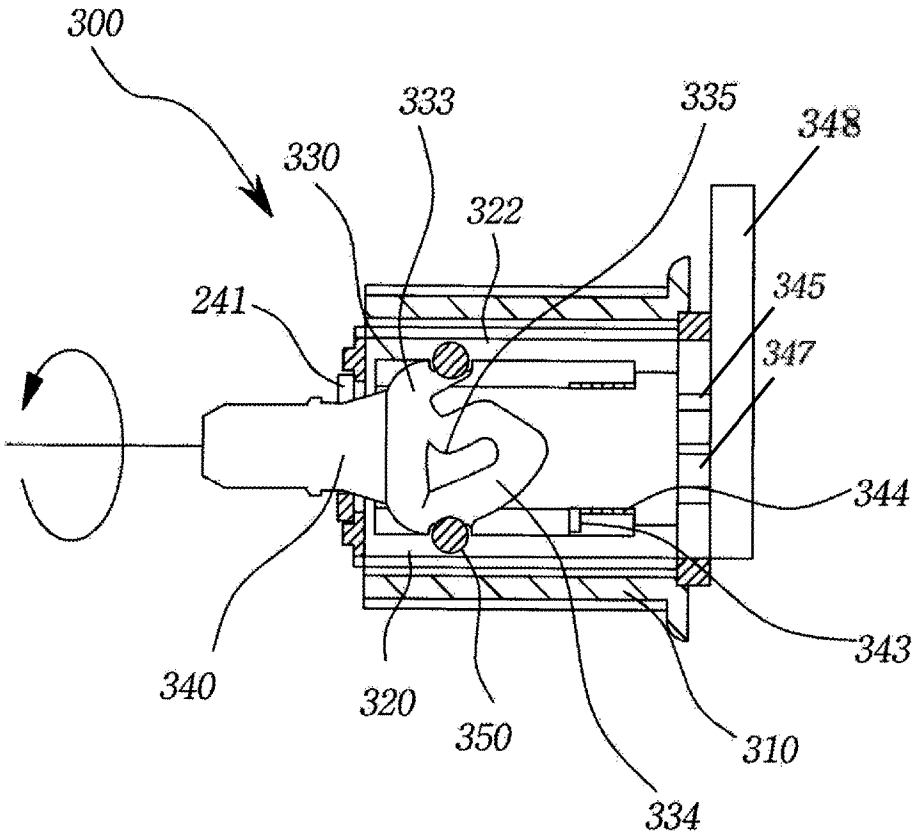

As illustrated in FIGS. 9 and 10, the lower end rod 371 of the front sheet may be gripped and pulled downward in a state in which the double fabric 110 is entirely wound around the winding drum, thereby moving the double fabric in the vertical direction. The four balls 350 located in a front side of the insertion groove 322 of the rotation component 320 are rotated in the guide groove 333 of the stopper 330. Simultaneously, the double fabric moves downward while the rotor on the opposite side is loading the spring. The fixing shaft 340 is in a fixed state, and the stopper 330 is rotated in a direction opposite to that of the spring 344 wound in a state in which the hook protrusion 343 of the spring 344 is coupled to the stopper. Simultaneously, the double fabric moves downward while the rotation component 320 is engaged with the stopper 340 and the four balls 350, and the cover 310 inserted into the coupling groove 321 of the rotation component 320 are rotated in the same direction.

Figure 11:
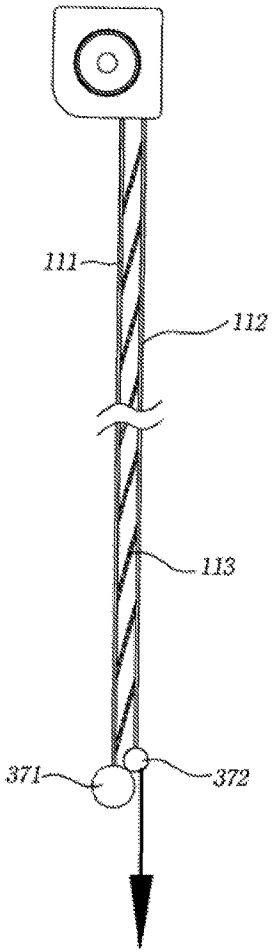
Figure 12:
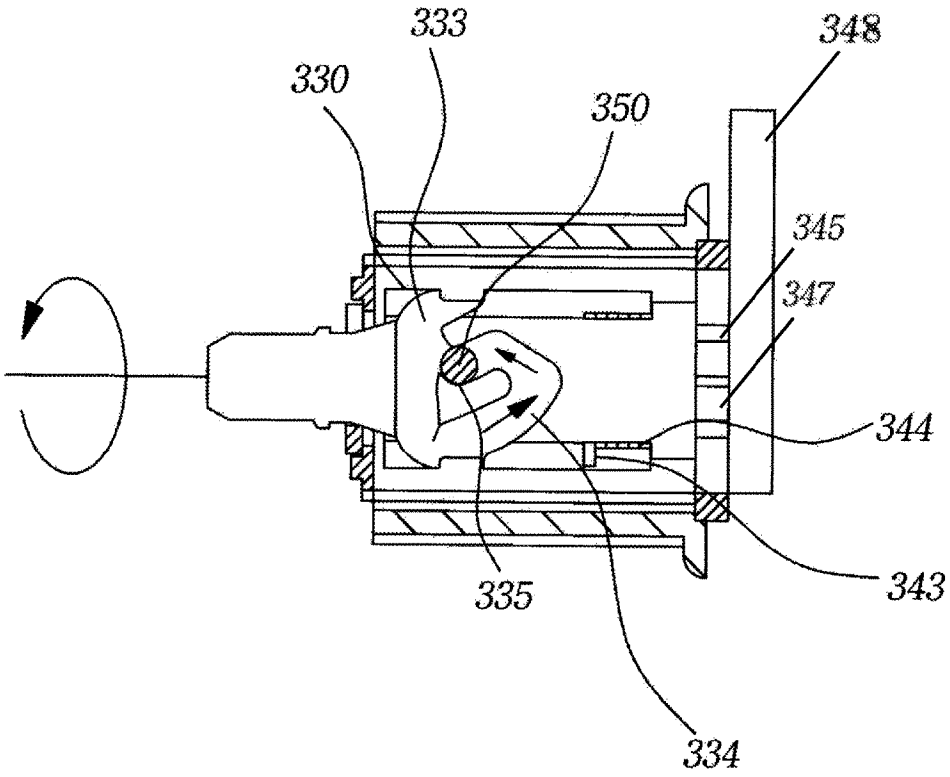
Figure 13:
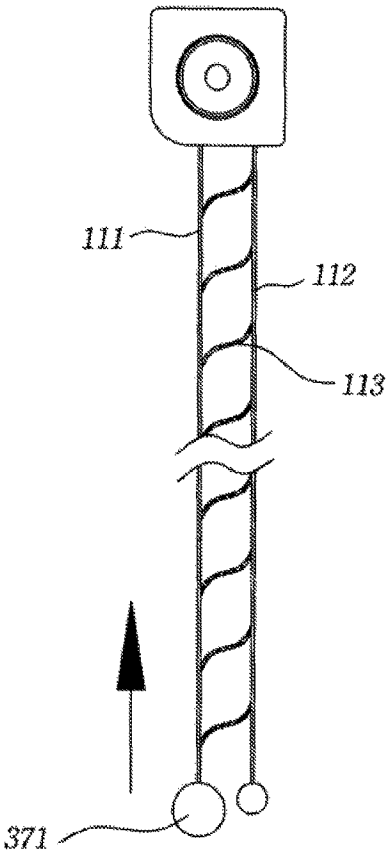

To allow sunlight to be transmitted to the inside by adjusting an degree of openness of the double fabric 110 in a state in which the double fabric 110 has moved downward to the lowest end, when the lower end rod 372 of the rear sheet is gripped and pulled downward as illustrated in FIG. 11, a first ball 350 of the four balls 350 moves along the inclined groove 334 and is located and stopped in the holding groove 335 as illustrated in FIG. 12, and simultaneously, the front sheet 111 moves upward to open the double fabric 110 as illustrated in FIG. 13. In particular, the first ball 350 of the four balls is held in the holding groove 335 when the rotation component 320 is rotated by 90 degrees to adjust the degree of openness of the double fabric, and when the lower end rod 372 of the rear sheet is pulled downward again, a second ball 350 is held in the holding groove 335 when the rotation component 320 is rotated by 90 degrees to further increase the degree of openness of the double fabric.

As described above, as the rotation component 320 is rotated by 90 degrees, the plurality of balls 350 may be sequentially held in the holding groove 355 to finely adjust the degree of openness of the double fabric. Also, according to embodiments of the present invention, eight balls 350 can be coupled to the insertion grooves 322 of the rotation component 320, and the stopper 330 is inserted into the rotation component 320, and thus the balls 350 are located in the guide groove 333 formed in the outer circumferential surface of the stopper 330. In this state, as illustrated in FIG. 11, when the lower end rod 372 of the rear sheet is gripped and pulled downward, the first ball 350 of the eight balls is held in the holding groove 335 when the rotation component 320 is rotated by 45 degrees to adjust the degree of openness of the double fabric, and when the lower end rod 372 of the rear sheet is pulled downward again, the second ball 350 is held in the holding groove 335 when the rotation component 320 is rotated by 45 degrees to further open the degree of openness of the double fabric.

Figure 14:
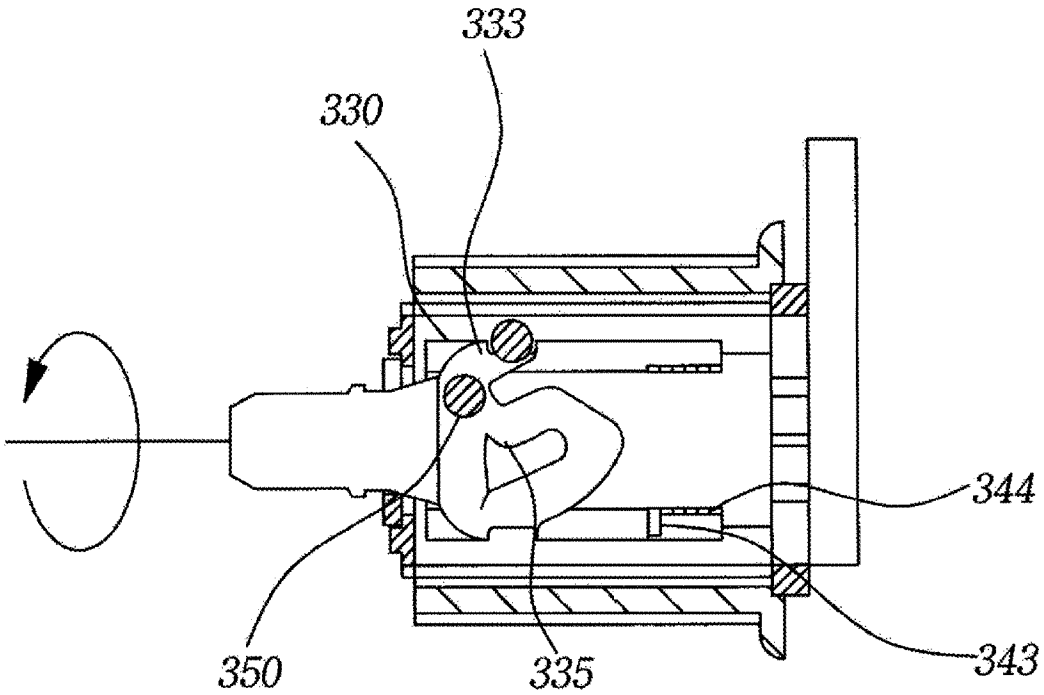
Figure 15:
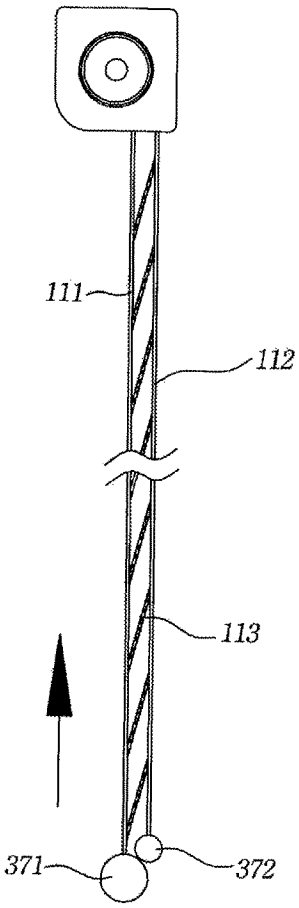

As described above, as the rotation component 320 is rotated by 45 degrees, the eight balls 350 may be sequentially held in the holding groove 355 to finely adjust the degree of openness of the double fabric. In this state, when the lower end rod 372 of the rear sheet is pulled downward such that the roller turns more than a holding angle, the ball 350 is removed from the holding groove 335 as illustrated in FIGS. 14 and 15. Simultaneously, the rotor on the opposite side is rotated as the spring loses its tension. The cover, to which the winding drum is coupled, is rotated and causes the double fabric 110 to move upward. The ball 350 may be located in the guide groove 333 of the stopper 330, which is the initial state.

What is claimed is:

1. An adjustment device for a shading assembly, the adjustment device comprising:

a rotatable hub having an axial aperture, the axial aperture defining an inner circumferential surface about a hollow interior of said rotatable hub, wherein the inner circumferential surface of said rotatable hub includes at least one axial groove for holding a ball therein;

a stopper positioned within the hollow interior of said rotatable hub and including an axial insertion hole therein, said stopper including an outer circumferential surface having a groove therein, wherein the groove is configured to cooperatively hold the ball in the at least one axial groove of said rotatable hub and includes a circumferential path with a locking position therein, and wherein the locking position prevents circumferential motion of the ball about the outer circumferential surface of said stopper;

a fixing member extending through the axial insertion hole of said stopper and the axial aperture of the rotatable hub;

a clutch including a spring disposed circumferentially about said fixing member adjacent to an axial end of the stopper and the rotatable hub, wherein the spring further includes a tang for engaging said stopper; and a cover disposed about said rotatable hub and rotatably engaging a double panel shading, the double panel shading including a plurality of connecting vanes, wherein rotation of said stopper with the ball in the locking position expands the spring of said clutch, thereby adjusting an angle of engagement between said fixing member and said cover and an angle of the connecting vanes in the double panel shading.

2. The adjustment device of claim 1, wherein the axial groove of said rotatable hub comprises one of a plurality of axial grooves disposed about the inner circumferential surface of said rotatable hub.

3. The adjustment device of claim 1, further comprising at least one bottom rail coupled to an end of the double panel shading, said at least one bottom rail being operable to move one panel of the double panel shading to move the ball through the groove of said stopper to the locking position therein and expandingly twist the spring of said clutch.

4. The adjustment device of claim 1, wherein said stopper includes an axial coupling groove for receiving the tang of the spring.

5. The adjustment device of claim 1, further comprising a protrusion disposed on one of an inner circumferential surface of said cover or an outer circumferential surface of said rotatable hub, wherein the protrusion operably couples said cover to said rotatable hub.

6. The adjustment device of claim 5, further comprising a clip coupled to an axial end of said fixing shaft and contacting the protrusion between said outer circumferential surface of said rotatable hub and said inner circumferential surface of said cover.

7. The adjustment device of claim 1, wherein a displacement of the spring relative to said stopper and the angular position of the spring further adjusts light transmission through the double panel shading.

8. The adjustment device of claim 1, wherein the groove of said stopper permits circumferential movement of the ball therein, into and out of the locking position, to selectively permit retraction of the double panel shading onto said cover.

9. The adjustment device of claim 1, wherein the axial groove of said rotatable hub extends substantially axially along a rotation axis of said stopper and said rotatable hub.

10. A transparency adjustment device for a shading assembly, the transparency adjustment device comprising:

a fixing shaft;

a stopper including an axial insertion hole for receiving said fixing shaft therein, and further including a ratcheting element on an outer surface thereof;

a clutch including a spring disposed about said fixing shaft, wherein the spring further includes a tang for matingly engaging the stopper; and a rotatable hub disposed about said stopper and operably rotatably engaging one of a pair of sheets of the shading assembly wound thereon, wherein said rotatable hub is configured to move the ratcheting element of said stopper into a rotational locking position, thereby engaging said rotatable hub with said stopper to permit expansion of the spring of said clutch within said rotatable hub about said fixing shaft, wherein the expansion of said spring of said clutch about said fixing shaft causes said rotatable hub to rotate about said fixing shaft and adjust a light transmission through the shading assembly, through operable rotatable engagement between said rotatable hub and the one of the pair of sheets wound thereon.

11. The transparency adjustment device of claim 10, further comprising a retractor spring operatively coupled to said rotatable hub, wherein the ratcheting element further includes an opposing locking position for preventing retraction of the pair of sheets about said rotatable hub by engaging said retractor spring, and wherein the ratcheting element of said stopper in the opposing locking position permits retraction of the pair of sheets about said rotatable hub.

12. The apparatus of claim 10, wherein the clutch is mounted circumferentially about the fixing shaft, axially adjacent to the rotatable hub and the stopper.

13. A method of actuating a double panel shading assembly including a pair of sheets wound onto an external hub, said method comprising:

rotating the external hub about an intermediate hub such that the external hub reaches a rotational locking position, wherein the external hub is rotatably coupled to the intermediate hub through a ratcheting element, the ratcheting element including a holding groove formed in the intermediate hub and a complementary holding groove formed in the external hub, wherein rotating the external hub includes guiding a plurality of balls through the holding groove and into the rotational locking position; and rotating the external hub and the intermediate hub together in the first rotational direction, the external hub being in the rotational locking position, to expand a spring clutch coupled to the intermediate hub about a shaft mounted within the intermediate hub through an axial insertion hole of the external hub, wherein the expanding of the spring clutch within the intermediate hub during said rotating of the external hub and the intermediate hub together causes the external hub to rotate about the shaft to adjust an angle of engagement between the external hub and the pair of sheets and an amount of light transmission through the double panel shading assembly.

14. The method of claim 13, further comprising applying a downward force to a rail coupled to at least one of said pair of sheets to rotate the external hub and the intermediate hub together in the first rotational direction.

15. The method of claim 14, wherein the rail is coupled to a lower end of each of said pair of sheets.

16. The method of claim 13, further comprising terminating said rotating of the external hub and the intermediate hub together in the first rotational direction to disengage the ratcheting element of the external hub and the plurality of balls from the rotational locking position and permit further rotation of the external hub relative to the intermediate hub.

17. The method of claim 13, wherein the rotational locking position of the ratcheting element includes a catch of the holding groove, and wherein rotating the ratcheting element to the locking position includes rotating the external hub to engage one of the plurality of balls within the holding groove with the catch.

18. The method of claim 13, wherein the complementary holding groove extends axially along an interior surface of the external hub.

19. The method of claim 13, wherein the rotational locking position of the ratcheting element comprises one of a plurality of rotational locking positions of the ratcheting element, each of the plurality of rotational locking positions providing a different adjustment of the angular displacement between the shaft and the external hub.

20. The method of claim 13, wherein the spring clutch is mounted circumferentially about the shaft, axially adjacent to the intermediate hub and the external hub.

* * * * *